US006231927B1

(12) United States Patent
Ruid

(10) Patent No.: US 6,231,927 B1
(45) Date of Patent: May 15, 2001

(54) METHOD OF COATING INSULATION BOARDS

(75) Inventor: John O. Ruid, Schwenksville, PA (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 09/327,020

(22) Filed: Jun. 8, 1999

(51) Int. Cl.[7] ..... B05D 3/12

(52) U.S. Cl. ..... 427/358; 427/243; 427/356; 427/389.8; 118/123; 118/126

(58) Field of Search ..... 427/356, 358, 427/243, 389.8; 118/123, 126

(56) References Cited

U.S. PATENT DOCUMENTS

| | | | | |
|---|---|---|---|---|
| 4,990,370 | | 2/1991 | Terry et al. | 427/209 |
| 5,310,594 | | 5/1994 | Holland et al. | 428/167 |
| 5,534,298 | * | 7/1996 | Cross et al. | 427/358 |
| 5,567,504 | | 10/1996 | Schakel et al. | 428/167 |
| 5,958,137 | * | 9/1999 | Caldwell et al. | 118/663 |
| 6,000,437 | * | 12/1999 | Ponder et al. | 138/149 |

FOREIGN PATENT DOCUMENTS 0 763 690 A2 3/1997 (EP) .

OTHER PUBLICATIONS

Weiss, Herbert L., Coating and Laminating, Converting Technology Comapny, Wilwaukee, Wisconsin, 1977, pp. 7–9, 196–202. (no month date).

* cited by examiner

*Primary Examiner*—Katherine A. Bareford
(74) *Attorney, Agent, or Firm*—Jeffrey C. Lew

(57) ABSTRACT

A method of coating a substrate of insulation material with a barrier layer involves spreading a curable liquid on a surface of the insulation using a spreader blade having a composite cross section profile. The profile includes a leading surface that converges toward the substrate surface and a trailing surface that is parallel to the substrate surface. The coating method is useful for fabricating acoustical and thermal energy insulation boards of nonwoven webs of glass fibers and other conventional insulation material. Particular benefit is derived from the method in coating grooved insulation boards for lining curved air conveying ducts with an elastically deformable, flexible coating that covers the board surface between grooves and bridges the grooves while leaving the groove channels open.

17 Claims, 4 Drawing Sheets

METHOD OF COATING INSULATION BOARDS

FIELD OF THE INVENTION

This invention broadly relates to a method of coating a surface of a substrate sheet with a layer of fluid utilizing a spreader blade. More specifically, the invention relates to uniformly spreading a curable liquid on a surface of an insulation board using a blade having a composite profile cross section with a leading surface converging toward the substrate surface and a trailing surface parallel to the substrate surface.

BACKGROUND AND SUMMARY OF THE INVENTION

Often it is desired, i.a., to reduce the transmission of heat and noise through sheet metal air conveying ducts or other structures to conserve energy, to maintain the conveyed air within a specified temperature range, to prevent moisture from condensing on surfaces, and/or to reduce offensive noise. One technique for reducing heat and noise transmission involves applying an appropriate insulating material to a surface of a wall of the structure. The insulation can be placed on an outside wall, but most effective sound dampening is usually achieved by insulating the interior wall, especially in air conveying ducts in heating, ventilation and air conditioning systems. Frequently system designs also call for installing thermal insulation inside ducts.

Acoustical and thermal insulation is typically made of generally flat, glass fiber nonwoven webs formed into batts or continuous rolls. Rigid and semi-rigid sheet of insulation board are also utilized for insulation purposes.

It is sometimes desirable to laminate one or both faces of the insulation with a skin of foil, mesh, paper, film and the like. This provides a surface for conveniently attaching the insulation to a wall, and adds somewhat to the structural integrity of the insulation. Moreover, a skin on the face of insulation exposed to air flow, especially in a duct, can reduce the amount of energy required to force air through the duct. It can also protect against erosion of the insulation thereby reducing or eliminating contamination of flowing air with insulation particles or contamination of the insulation by toxic, corrosive, liquid or solid particles or other undesirable components in the air stream.

In certain applications, the skin can be produced in situ, that is, by depositing a layer of fluid capable of curing to a solid onto a surface of bare insulation material, and then curing the fluid. The fluid can be applied in many ways, for example, by spraying, dipping and roller coating. Coating of insulation material is unique in that the substrate can be semi-rigid or non-rigid, very porous, compressible and it can have a textured surface due to the fibrous nature of the insulation. Additionally, the coating fluid usually is quite viscous. It has been found particularly desirable to utilize a blade coating apparatus to coat insulation material.

Blade coating generally involves placing a thick deposit of coating fluid on the surface of the substrate positioned on one side of a broad, rigid blade. The blade then is dragged across the stationary surface causing the fluid to spread out and form a layer on the surface as it is over run by the blade. For example, U.S. Pat. No. 5,567,504 provides a glass fiber duct board with coated grooves. The patent discloses a method of cutting grooves into a face-coated insulation board, depositing a polymeric coating material into the grooves and then distributing the deposited material over the surfaces of the grooves with a wiper blade to coat the surfaces.

Traditional coating blades have a rectilinear cross section profile (having right-angled, or "square-edged" leading and trailing surfaces) or curvilinear cross section profile (oval, elliptical, circular, etc.). These blades have certain drawbacks. Square-edged boards tend to snag the rough surface of the substrate and can cut and/or tear the insulation. It also produces a coating layer of irregular thickness. This behavior is particularly aggravated when coating grooved insulation boards as described in U.S. Pat. No. 6,000,437. In the cited application, the coating blade is moved across the surface of the grooved board in a direction perpendicular to the grooves. On encountering a groove, the blade tends to sink into the groove and on leaving the groove, to pull on the forward-facing wall of the groove. Not only is this destructive of the insulation but it produces gaps in the coating which prevents formation of a continuous barrier layer of cured coating material that bridges the grooves. Curvilinear cross section coating blades tend to force the coating fluid too far beneath the surface of the insulation material.

It as been discovered that in situ coating of insulation material with a curable fluid can be routinely achieved to produce high quality coated insulation at high productivity by utilizing a spreader blade with a special cross section shape. The cross section is characterized by a composite profile comprising a leading surface that converges toward the substrate surface, and a trailing surface that is parallel to the surface. Accordingly, there is now provided by this invention a method of coating a sheet comprising, (a) depositing a bead of coating material on a surface of the sheet;

(b) positioning a spreader blade adjacent the sheet; and (c) moving at least one of the blade and sheet relative to each other parallel to the surface in a machine direction which causes the bead to contact the blade and to flow between the blade and the sheet, thereby spreading the coating material to a layer of uniform thickness on the sheet;

in which the spreader blade has a cross section perpendicular to the surface defining a composite profile comprising a leading surface converging toward the surface and a trailing surface parallel to the surface.

DETAILED DESCRIPTION

Figure 1:
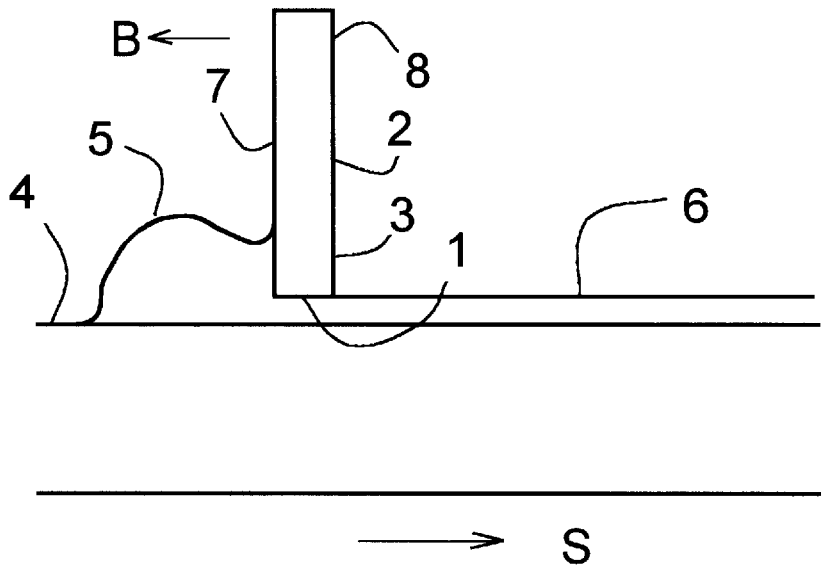
Prior Art Fig. 1
FIG. 1 is a schematic elevation view of a rectilinear cross section coating blade being used to coat a substrate.

FIG. 1 schematically illustrates a typical apparatus for blade coating a substrate. A rectilinear cross section coating blade 2 is positioned above a substrate 4 to be coated. The coating blade 2 is an elongated rigid block having a long, cross machine dimension extending perpendicular to the plane of the Figure. The blade is usually constructed of tool quality metal. A thick bead 5 of fluid coating material is placed on the substrate and at least one of the blade and substrate are moved relative to each other parallel to the surface of the substrate in a machine direction. That is, the substrate can remain stationary while the coating blade is moved as shown by arrow B, or the coating blade can be fixed while the substrate moves as shown by arrow S, or both coating blade and substrate can be in motion. Preferably, the coating blade is held stationary while only the substrate moves.

Movement of substrate and/or coating blade causes the bead to contact the blade and to flow between the tip 3 of the blade and the surface of the substrate which is also positioned perpendicular to the plane of the Figure. This spreads the coating material to form a layer 6 on the substrate surface. The tip 3 of the illustrated blade is characterized by a straight cross section profile 1 parallel to the substrate surface and which extends fully across the thickness of the coating blade from leading face 7 to trailing face 8. Hence, the leading and trailing faces of this tip meet the straight profile 1 at right angles.

Figure 2:
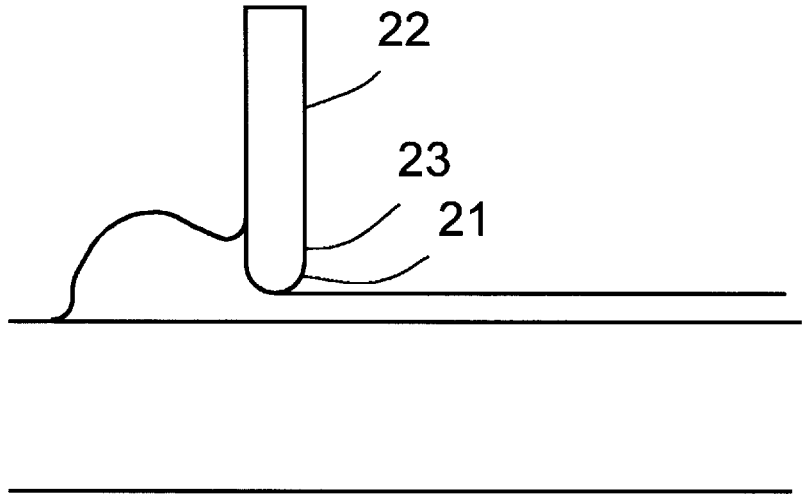
Prior Art Fig. 2
FIG. 2 is a schematic elevation view of a curvilinear cross section coating blade being used to coat a substrate.

FIG. 2 schematically illustrates another embodiment of a typical blade coating apparatus in which the coating blade 22 has a tip 23 comprising a semi-cylindrical, curvilinear profile 21. Thus the leading and trailing faces of this tip meet in a curve.

In the figures, the tip of the coating blade is shown positioned vertically away from the surface of the substrate by a gap distance for clarity. The gap distance can vary depending upon the porosity of the substrate, viscosity of the coating fluid and desired thickness of the coating on the substrate surface. For coating of porous, nonwoven fibrous insulation material, as will be further described, only a very thin coating layer is sought, and therefore, the tip of the coating blade is positioned to contact the surface of the substrate. The blade can be pressed against the substrate surface. The pressure can temporarily slightly deform the substrate, particularly compressible insulation material such as nonwoven glass fiber web.

Figure 3:
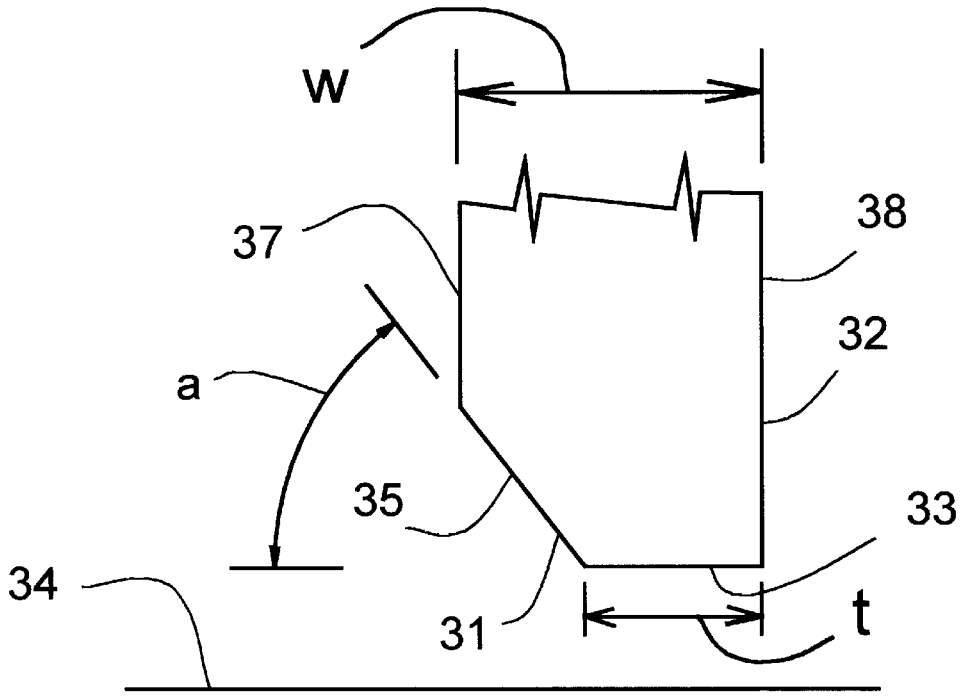
FIG. 3 is a side elevation view of the tip of a preferred embodiment of the spreader blade according to this invention.

A preferred embodiment of the spreader blade according to the present invention is shown in FIG. 3. The spreader blade tip 32 has a cross section perpendicular to the substrate surface which defines a composite profile 31. The term "composite profile" means that the cross section of the tip which spreads the fluid has multiple sections. In the illustrated embodiment, the composite profile includes one section defining a planar leading surface 35 that forms a bevel with respect to a second section defining a planar trailing surface 33. The planar trailing surface is parallel to the substrate surface 34. The leading and trailing surfaces thus meet at an angle of convergence a. Preferably the angle of convergence should be about 30–80 degrees, and more preferably about 45–60 degrees. The trailing surface of composite profile should extend beyond half the width of the blade. That is, the distance between leading face 37 and trailing face 38 defines the blade width w and the thickness t of the blade at the trailing surface should be more than about 50% of w.

Figure 4:
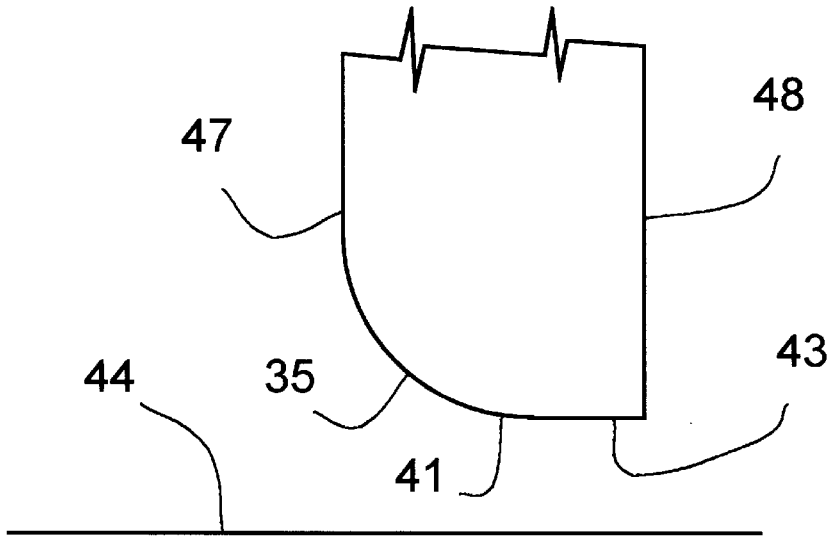
FIG. 4 is a side elevation view of the tip of another preferred embodiment of the spreader blade according to this invention.

FIG. 4 shows another preferred embodiment of the novel spreader blade tip for use in this invention. The blade has a composite profile 41 comprising a curved leading surface 45 in the form of a fillet with respect to planar trailing surface 43 and leading face 47. The trailing surface should be more than 50% of the blade width between leading face 47 and trailing face 48 and it should be oriented parallel to the surface 44 of the substrate to be coated.

The present invention is well suited to placing a coating on at least one surface of thermal or sound insulating material substrate. These insulation materials are usually in the form of batting or boards to attenuate the transmission of thermal energy through or sound along structural surfaces, such as walls and ducts.

The substrate to which the coating is applied generally is of nonwoven fibers or foam having a porous structure which has an exposed surface of rough texture on a micro scale. That is, at the scale of millimeters and smaller, the fibers and foam of the substrate define an uneven, grainy surface with peaks and valleys of typically random and irregular height, depth and span.

The substrate can be any of the well known insulating materials. Such materials span the range from light weight, flexible and resiliently compressible foam and nonwoven fiber web to rigid or semi-rigid boards. Generally, these insulating materials have density in the range of about 0.5–7 lbs/ft$^3$ (8–112 kg/m$^3$). Foam and nonwoven fiber web materials are usually provided in continuous sheeting which is sometimes cut to preselected lengths, thus forming batts. These articles usually are low density in the range of about 0.5–6 lbs./ft$^3$ (8–96 kg/m$^3$), and preferably about 1–4 lbs./ft$^3$ (16–64 kg/m$^3$). Rigid to semi-rigid insulation boards tend to have density in the higher portion of the range, at about 2–7 lbs./ft$^3$ (32–112 kg/m$^3$), and preferably about 4–7 lbs./ft$^3$ (64–112 kg/m$^3$). These boards customarily are produced as sheets typically in the range of 0.25–2 inches in thickness and about 2–4 feet wide by about 4–12 feet long.

A preferred substrate includes a flexible, resilient, low density web of nonwoven fibers. This web can be formed by various methods well known in the art including dry laying processes, such as air laying, melt blown and spunbond processes, wet laying processes and combinations of them. The fibers in the web can be loose or held together at random or non-random points of intersection with other fibers by mechanical methods, such as stitching or by adhesive methods. Synthetic fibers, especially thermoplastic fibers can be thermally bonded at such intersection points. The surface can be naturally textured and texture can optionally be augmented with carding or needle punching. Substrate of nonwoven glass fiber insulation material is particularly preferred.

A composite substrate of multiple nonwoven webs is also contemplated by this invention. The multiple webs can be stacked without being bound to adjacent layers or the composite can be laminated by binding some or all of adjacent layers by mechanical, adhesive or thermal methods of the types previously mentioned. A preferred type of composite web substrate includes a thick, e.g., about 0.5–6 inch (1.3–15 cm) nonwoven base web faced with a second, much thinner web, occasionally referred to herein as a mat, which can be a nonwoven, a net or a scrim fabric. The mat typically is a very open, high porosity web of thickness preferably about 0.006–0.060 inch (0.15–1.5 mm) and more preferably about 0.010–0.030 inch (0.25–0.76 mm). In such composite, the coating can be applied onto the side of the substrate faced with the mat, i.e., on top of the mat. Among other things, the mat provides to the coarse fiber structure of the base web a smoother surface than would be otherwise achieved.

The diameter of insulation material fiber suitable for use in this invention preferably is in the range of 3 to 25 $\mu$m. Mineral fibers, synthetic, usually thermoplastic polymer fibers, cellulosic fibers and mixtures of these can be used. Generally, the overall thickness of the body layer is about 0.5–6 inches (1.3–15 cm) thick. Flexible, resilient foam, such as polystyrene, is also a preferred insulation material. Optionally, the substrate of this invention can be faced, preferably on the side opposite the coated side, with an outer layer of metal foil, organic film, paper or combination. Examples include aluminum foil, polyethylene film and kraft paper. This outer layer can be tailored to provide additional protection to the insulating material of the body layer, improved stiffness, a surface to grip the composite for mounting in an end use application, or barrier properties, such as moisture permeation resistance.

The coating composition is largely selected for ability of the cured coating to protect the insulating material substrate from erosion by gas and/or particles flowing adjacent to the insulation and to prevent the escape of fibers or other particles from the insulation into the neighboring environment. The cured coating can also have insulating properties. The coating composition should also be chosen for ease of application and ability to readily cure to a preferably non-tacky solid which can firmly bind to the substrate. The cured coating can be porous or non-porous depending upon whether vapor transmission across the coating is wanted.

The coating material can be selected from well known materials, especially polymers, that can be applied to the substrate as a liquid and cured to a solid. The term "curing" is used broadly to include various processes such as chemical reaction and or drying that cause the composition to set to a non-tacky solid and to permanently bond to the substrate. For example, the liquid can be a solution of a high molecular weight polymer in a volatile solvent or a dispersion of solids in a liquid vehicle. Such liquid can be cured by drying, i.e., by devolatilizing the solvent or liquid vehicle. The liquid can also be a reactive polymer precursor which can be cured by reaction with a comonomer, catalyst, and/or introduction of heat, light, radiation and the like.

In a preferred embodiment, the cured coating material forms an elastically deformable, flexible and resilient composition. Preferably, the elastically deformable composition includes a polymeric component, such as acrylic polymer, styrenic polymer, polyvinyl acetate, and mixtures thereof. The polymeric component can be any well known elastomeric polymers, such as the polymeric latex composition disclosed in U.S. Pat. No. 5,567,504, the complete disclosure of which is incorporated herein by reference. An acrylic polymer latex is preferred.

When applied to the substrate surface according to the novel method, the coating material is a highly viscous liquid. The viscosity of the liquid in a quiescent condition at room temperature should be about 1,000–500,000 cps, and preferably about 10,000–200,000 cps. Liquids contemplated for coating in accordance with this invention frequently exhibit a shear thinning behavior. That is, the viscosity lowers upon application of shear. Because the process of applying the coating liquid typically involves shearing the liquid, the viscosity during casting onto the body layer can be lower than the indicated quiescent liquid viscosity.

The novel method generally calls for providing a sheet of substrate preferably in a horizontal orientation with the surface to be coated facing up. A quantity of liquid coating material is placed on the surface. Usually the sheet has a rectangular surface and the coating material thus should be applied in a thick bead extending substantially completely across the cross machine direction dimension of the surface. The substrate sheet should be adequately supported from below by tables, conveyors and the like to maintain the top surface substantially planar. The coating apparatus should have an elongated spreader blade positioned horizontally and extending in a cross machine direction at a distance above the surface selected to obtain a desired uniform coating thickness. The bottom of the spreader blade can be in contact with the surface and can be weighted or tensioned with springs, for example, to ride upon the surface as the substrate moves beneath the spreader blade. In the preferred mode of operation, the sheet is moved in a machine direction toward the spreader blade which is maintained in a fixed machine direction position. The motion causes the bead of coating liquid to approach and then contact the leading face of the spreader blade. At the tip of the blade the bead first contacts the leading surface of the composite profile which is shaped to converge toward the surface of the sheet. The bead is reduced to desired thickness as it passes between the trailing surface of the spreader blade composite profile which is parallel to the horizontal substrate surface. After passing the spreader blade the substrate sheet should have a uniform thickness coating of curable liquid on its upper surface. The wet sheet is then conveyed through a curing zone where the liquid cures to a solid. The sheet can go through additional optional steps such as end coating, cooling and trimming. The coated sheet is then packaged for storage and shipment to site of use. Any traditional method of packaging can be employed, such as winding up on a spool or stacking on pallets. The method chosen will depend largely on the properties of the coated sheet.

The spreader blade having a composite profile cross section according to this invention is particularly useful for coating grooved insulation boards. Grooved insulation boards have recently been developed for insulating the interior of curved ducts, particularly air conveying ducts in heating, ventilation and air conditioning systems. The board can be flexed about an axis parallel to the grooves and thereby caused to conform closely to the shape of the curved duct. It is desirable to coat the conveyed air contact surface of grooved boards with an elastically deformable, flexible and resilient composition. It is especially important to coat grooved boards such that the elastically deformable coating bridges over the grooves as well as covering the surface between grooves. Such bridged coating advantageously separates the insulation material of the walls and floors of the grooves from the conveying air and thus prevents contamination of the air with insulation particles. Fabrication and coating of grooved insulation boards is disclosed in U.S. Pat. No. 6,000,437, the entire disclosure of which is incorporated herein by reference.

In a particularly preferred embodiment, a composite insulation board to be coated comprises a thick layer of insulation material faced with a highly porous, very thin mat of glass fibers as mentioned above. Parallel grooves are then cut through the face and into the thick layer. The coating is then laid onto the insulation utilizing a composite cross section profile spreader blade so that the coating spreads smoothly on the matted surface of the board and bridges over the grooves.

Figure 7:
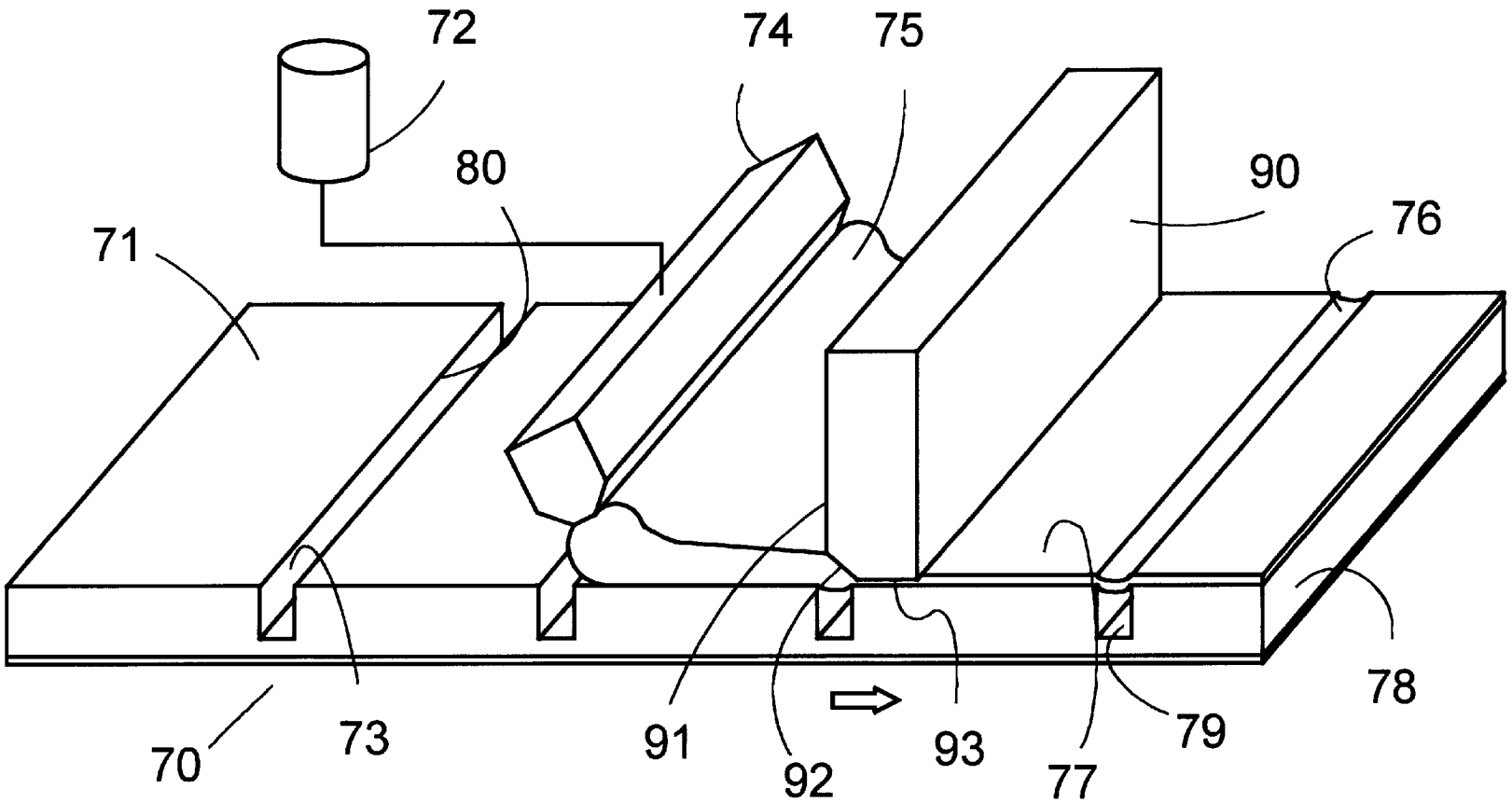
FIG. 7 is a schematic view of an apparatus adapted to coat a grooved insulation board according to an embodiment of the method of this invention.

An apparatus adapted to apply a coating to a grooved insulation boards according to this invention is illustrated in FIG. 7. The insulation board 70 to be coated has been produced initially as an ungrooved web or sheet of insulation material in conventional manner. Then parallel grooves 73 were cut into one face of the board. The number of grooves cut into any particular insulation board is determined by the degree of curvature that is desired of the flexed board and is not limited to the number shown in the figures. The number of grooves is a function of the gap size, the spacing between adjacent grooves and the length of the sheet. Thickness of the insulation material, cross section shape of the groove and depth of the groove can play a role in choosing gap size. Gap size generally is in the range of about 1/16–1/2 inch, and preferably is about 1/8–3/8 inch. By spacing between adjacent grooves is meant the distance between axial centerlines. Equal spacing between all adjacent grooves of an insulation sheet is preferable, however, sheets adapted to special utilities can have unequal spacings. Groove spacing in the range of about 1–3 inches is preferred for sheets with central blocks of about 1–6 inch thickness and gap size of about 1/16–3/8 inch.

A liquid coating composition in form of foam is prepared in an appropriate make up facility 72 represented schematically and conveyed to the site of application through a transfer line. The transfer line terminates in an applicator nozzle 74 which is adapted to deposit a bead 75 of foam on the front face 71 of the insulation board 70. For example, the foam can be placed onto the block by one or more nozzles or by one or more slit dies. Initially, the bead is laid near a leading lateral end 78 of the board. Preferably, a box coater apparatus can be used for this operation. The box coater is configured in the form of a topless box-shaped enclosure typically defined by (a) the web to be coated on the bottom, (b) two vertical side walls extending in the machine direction and positioned adjacent to the edge of the web, (c) a vertical cross machine direction wall abutting the top surface of the web and (d) a spreader blade forming another cross machine direction wall. The liquid composition can be deposited by a single nozzle into the box where it is confined by the four walls as the web moves toward the coating blade.

A spreader blade 90 mounted on support equipment, not shown, is brought in contact with the bead 75 as the board 70 is drawn forward in machine direction indicated by the arrow by support and conveying means, not shown. The bead first contacts the leading face 91 of the spreader blade and is directed beneath the blade by the leading surface 92 of the blade tip composite profile. The bead is spread as it passes between the trailing surface 93 of the blade tip. The wet coating composition thus forms a generally uniform thickness coating 77 which is seen to bridge over the groove 76.

After a uniform coating of foam has been laid down, the foam is devolatilized. This can be accomplished by simply waiting for the foam bubbles to destabilize with time or by accelerating devolatilization. Representative accelerating techniques include, for example, heating the foam coated board, blowing a dry gas onto the surface of the foam and a combination of these. Finally, the composite insulation sheet can be treated by means adapted to cure the polymeric component of the foam in such a way as to set a self supporting, uniform, layer on the insulating material. The layer of cured coating composition leaves a covered but open groove channel 79. Because the channel remains free of coating material, the board remains flexible about the groove axes, and hence, conformable to curvature of non-planar air conveying ducts.

The clearance between the trailing surface 93 of spreader blade 90 and front face 71 illustrated in FIG. 7 is exaggerated for sake of clarity. In actual practice, the clearance should be much smaller and is likely be non-existent, i.e., the blade touches or even presses into the front face. A primary advantage of the composite profile spreader blade cross section is apparent during coating grooved boards with small and zero clearances between blade and board surface. Specifically, the combination of a leading surface oriented at an angle converging towards a trailing surface parallel to the board surface prevents the blade from snagging and destroying the front face 71 especially at the forward facing edge 80 of the grooves while producing uniform and complete coverage of the board face and bridged, open channel grooves.

Snagging can be particularly problematic when fibers present in the insulation material protrude to irregular elevations above the plane of the front face. It has been found that a right angle or near right angle blade tip leading surface cross section, as seen in FIG. 1 for example, is quite prone to descend into the grooves and/or to catch the forward facing groove edges. If a fully rounded blade tip cross section as shown in FIG. 2 is used, preference is given to pressing the tip against the board surface in order to achieve desired thickness of wet coating 77. This tends to force the coating material into the grooves and thus produces excessive defects due to groove channels blocked with cured coating composition.

EXAMPLES

This invention is now illustrated by examples of certain representative embodiments thereof, wherein all parts, proportions and percentages are by weight unless otherwise indicated.

Continuous hot glass fibers were blown onto a moving collector surface and compressed to form a 1 inch thick and 4 feet wide continuous nonwoven web of insulation material. A sheet of foil/scrim/kraft was laminated to one face of the insulation material. The laminated web was cut to boards of 10 feet long. A plurality of rectangular cross section grooves were cut into the unlaminated face and extending parallel to the width of the boards. The grooves were cut to a depth of ¾ inch and a width of 3/16 inch. In one series of boards, the center-to-center distance between grooves was 1.5 inch and in another series the distance was 3 inches. The boards were temporarily stacked on pallets of 45 boards per pallet.

The boards were sequentially unloaded from the pallets and fed with the grooves facing upward and extending in cross machine direction onto a moving conveyor of a continuous blade coating apparatus. The boards passed horizontally beneath a trough containing aerated foam of acrylic polymer dispersed in water. The foam was aerated to a "cup weight" of 40 g and continuously deposited onto the surface of the board in a bead extending across the cross machine direction dimension. Cup weight was measured by weighing a tared cup of 200 ml volume that had been filled with foam and leveled to the brim. The conveyor then carried the foam coated board under a stationary coating blade also extending along the full cross machine direction such that the bottom of the blade was in contact with the top, uncut surface of the board, i.e., the surface of the board between grooves.

The blade was a 1 inch high stainless steel block inset into a holding bar and shaped as in FIG. 3 with the following dimensions: width (w) 0.375 inch, trailing surface thickness (t) 0.25 inch, and convergence angle 56.31°. The blade was positioned so that the convergence angle faced toward the oncoming board.

The boards were drawn through the coating apparatus in the machine direction at 40 feet per minute. The boards were carried through a heated foam settling and drying oven during which the coating material solidified in a generally uniform thickness layer on the top surface and bridging the grooves of the board. By measuring the weight difference of coated and uncoated board it was determined that the dry coating density was about 11 g per square foot. The dried boards were loaded on pallets for storage and transport.

Quality of coating was determined by visual inspection. Types of defects occasionally found included (a) less than complete bridging of a groove, (b) bubbled coating, (c) excessively thick coating which stuck to back face of next board stacked above on pallet, (d) broken blisters leaving heavy layers of coating, and (e) area(s) of glass fiber pulled from nonwoven web. The boards were also tested by flexing about the axes of the grooves to form tubes of 3 foot diameter, unfolding the tube and noting any cracks formed in the coating bridging the grooves. Results of the test are tabulated below:

| Trial Designation | Groove Spacing (inches) | Number of Boards Processed | Number of Defective Boards | Defect % | Remarks |
|---|---|---|---|---|---|
| 80610-190L | 3 | 40 | 3 | 7.5 | |
| 80610-190S | 1.5 | 45 | 5 | 11.1 | |
| 80611-192S | 1.5 | 1,170 | 73 | 6.2 | Increasingly improved center-to-edge coating, generally complete |

-continued

| Trial Designation | Groove Spacing (inches) | Number of Boards Processed | Number of Defective Boards | Defect % | Remarks |
|---|---|---|---|---|---|
| 80616-000L | 3 | 540 | 16 | 3.0 | groove bridging |

Figure 5:
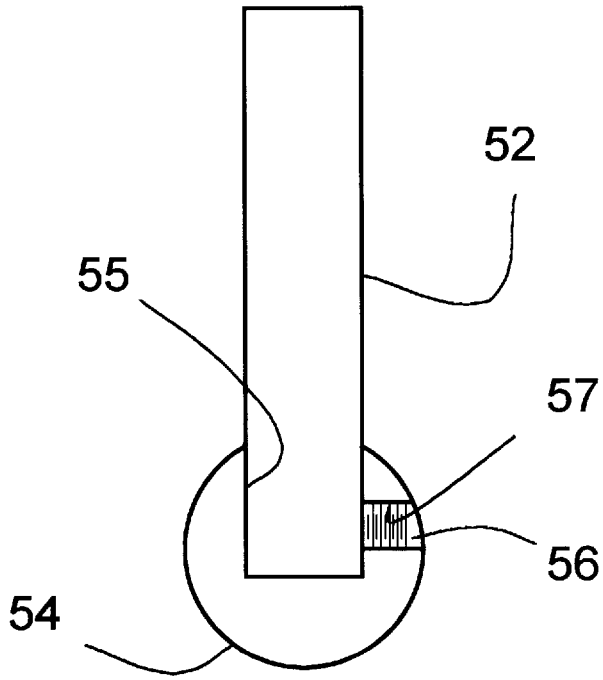
FIG. 5 is a side elevation view showing the construction of a curvilinear cross section coating blade.

For comparison 22 insulation boards with 1.5 inch groove spacing and 10 ungrooved insulation boards prepared substantially as described above were coated on the same apparatus with a 50 g cup weight foam at a line speed of 50 feet per minute. Initially, a 0.375 inch thick, flat bottom blade, as shown in FIG. 1, was used and after attempting to coat several boards, a round bottom blade as shown in FIG. 5 was used. The latter blade was made of a 0.375 inch thick rectangular stainless steel bar 52 to one edge of which a 0.75 inch diameter cylindrical stainless steel rod 54 was fastened. The rod was machined to form a 0.375 inch wide groove 55 along its length. The edge of the rectangular bar was inserted into the groove and held in place by a plurality of set screws 56 that were screwed into threaded holes 57 drilled into the rod. Only about three of the 32 boards were deemed to have coated acceptably. Many boards sustained physical damage during coating.

Figure 6:
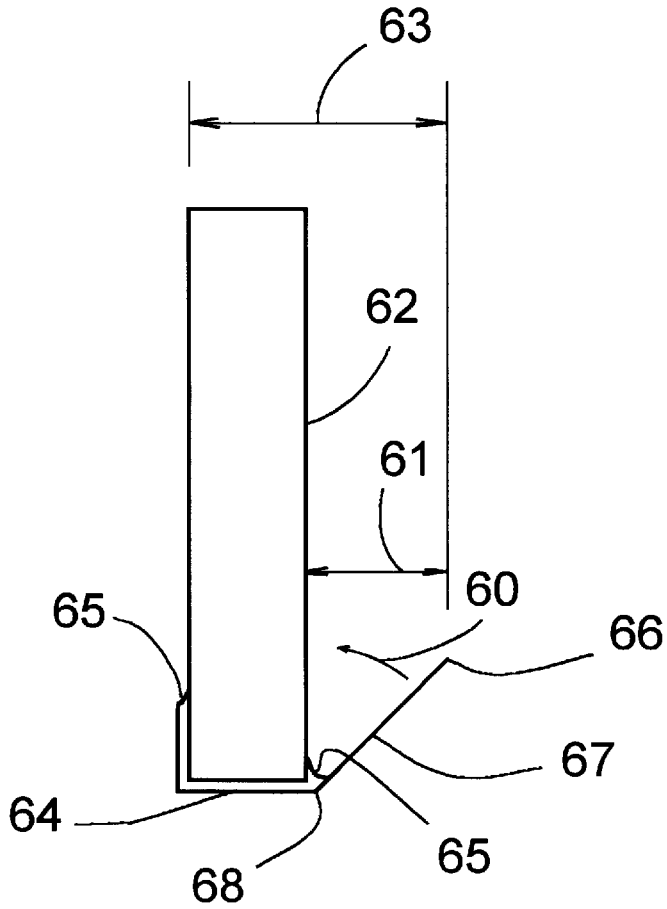
FIG. 6 is a side elevation view of a composite profile spreader blade.

In another trial, a composite profile blade as shown in FIG. 6 was utilized in grooved board coating operation substantially as described above. This blade was formed from a rectangular bar 62 to one edge of which a trifolded metal strip 64 had been attached by welds 65. The distance 61 between the foremost rim 66 of the leading foil 67 was about equal to the width of the rectangular bar stock. Thus the trailing surface of this composite profile blade was about 50% of the effective blade thickness 63. Because the leading foil was only fixed to the rectangular bar at its bottom edge 68, force of board and foam movement against the blade tended to flex the leading foil in the direction of arrow 69 which increased the angle of convergence. As a result, this blade generally pushed foam too deeply into the grooves and damaged the leading edges of many boards.

Although specific forms of the invention have been selected for illustration in the drawings and the preceding description is drawn in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A method of coating a sheet having a surface and a height comprising, (a) creating a plurality of parallel grooves which penetrate into the sheet from the surface to a depth less than the height (b) depositing a bead of coating material on a surface of the sheet;

(c) positioning a spreader blade adjacent the sheet; and (d) moving at least one of the blade and sheet relative to each other parallel to the surface in a machine direction which causes the bead to contact the blade and to flow between the blade and the sheet, thereby spreading the coating material to a layer of uniform thickness on the sheet;

in which the spreader blade has a cross section in the machine direction defining a composite profile comprising a leading surface converging toward the surface and a trailing surface parallel to the surface, and in which the spreader blade causes the coating material to bridge over the grooves to define channels within the grooves that remain unblocked by coating material.

2. The method of claim 1 in which the spreader blade has a forward face and a rearward face defining a blade thickness therebetween, and in which the trailing surface extends over more than 50% of the blade thickness.

3. The method of claim 2 in which the leading surface cross section is a fillet.

4. The method of claim 2 in which the leading surface cross section is planar.

5. The method of claim 4 in which the leading surface meets the trailing surface at an angle of convergence to the surface of about 45 to about 60 degrees.

6. The method of claim 1 in which the sheet comprises insulation material.

7. The method of claim 6 in which the insulation material is nonwoven web of glass fiber.

8. The method of claim 7 which prior to the depositing step further comprises the step of facing the surface of the sheet to be coated with a porous mat about 0.006–0.060 inch thick of a nonwoven, a net or a scrim fabric.

9. The method of claim 6 in which the spreader blade contacts the surface during the moving step.

10. The method of claim 6 in which the spreader blade is positioned away from the surface by a gap adapted to deposit a portion of the uniform thickness on the surface of the sheet.

11. The method of claim 1 in which prior to the creating of grooves step, further comprises the step of facing the surface of the sheet to be coated with a porous mat of glass fiber about 0.006–0.060 inch thick.

12. The method of claim 11 in which the grooves are aligned transverse to the machine direction.

13. The method of claim 11 in which the grooves have a gap size and the trailing surface of the spreader blade has a thickness greater than the gap size.

14. The method of claim 1 in which the coating material is a curable fluid.

15. The method of claim 4 in which the method further comprises the steps of curing the fluid to an elastically deformable substance.

16. The method of claim 15 in which the curable fluid comprises a foamed polymeric composition.

17. The method of claim 16 wherein the curing step includes heating the foamed elastically deformable substance at an elevated temperature and for duration effective to remove all liquid from the foam.

* * * * *

UNITED STATES PATENT AND TRADEMARK OFFICE

CERTIFICATE OF CORRECTION

PATENT NO. : 6,231,927 B1
DATED : May 15, 2001
INVENTOR(S) : John O. Ruid

It is certified that error appears in the above-identified patent and that said Letters Patent is hereby corrected as shown below:

Column 10, claim 15,
Line 49, delete "4" and substitute -- 14 -- therefor.

Signed and Sealed this

Sixth Day of November, 2001

*Attest:*

Nicholas P. Godici

*Attesting Officer*

NICHOLAS P. GODICI
*Acting Director of the United States Patent and Trademark Office*